US006527231B2

(12) United States Patent
Dietze et al.

(10) Patent No.: US 6,527,231 B2
(45) Date of Patent: Mar. 4, 2003

(54) SUPERSTRUCTURE POINTS DEVICE

(75) Inventors: Hans-Ulrich Dietze, Wusterwitz (DE); Burkhard Zillien, Butzbach (DE)

(73) Assignee: BWG Butzbacher Weichenbau GmbH & Co. KG, Butzbach (DE)

( * ) Notice: Subject to any disclaimer, the term of this patent is extended or adjusted under 35 U.S.C. 154(b) by 0 days.

(21) Appl. No.: 09/814,739

(22) Filed: Mar. 23, 2001

(65) Prior Publication Data

US 2001/0025904 A1 Oct. 4, 2001

(30) Foreign Application Priority Data

Mar. 31, 2000 (DE) ..... 100 16 015

(51) Int. Cl.[7] ..... E01B 7/00
(52) U.S. Cl. ..... 246/415 R
(58) Field of Search ..... 246/415 R, 435 R, 246/436; 238/2, 3, 8

(56) References Cited

U.S. PATENT DOCUMENTS 3,955,761 A * 5/1976 Szarka et al. ..... 104/11
4,982,919 A * 1/1991 Durchschlag et al. ..... 246/382
5,224,672 A * 7/1993 Testart ..... 104/130.01
5,513,797 A * 5/1996 Lesley ..... 238/128
5,577,691 A * 11/1996 Erich et al. ..... 246/436
6,068,195 A * 5/2000 Gaudet ..... 283/3

FOREIGN PATENT DOCUMENTS

DE 4201757 12/1993

* cited by examiner

*Primary Examiner*—S. Joseph Morano
*Assistant Examiner*—Robert J. McCarry, Jr.
(74) *Attorney, Agent, or Firm*—Dennison, Schultz & Dougherty

(57) ABSTRACT

The invention relates to a superstructure points device, in particular intended for a grooved rail, comprising a box-like substructure (32) with stock rail (14), if necessary an additional/supporting rail (16) and slide plate (18) on which a tongue rail (20) is slidably mounted. In order to mount the rails of the points device elastically, while also allowing the option of simple removal from the rail/road bed, it is proposed that the box-like substructure (32) is mounted elastically in a stationarily arranged frame (38) of the points device.

23 Claims, 3 Drawing Sheets

Figure 1:
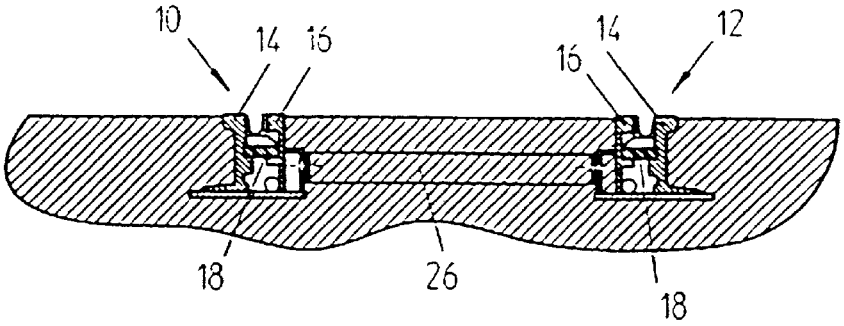

88
68
64
114
60
88
68
64
A
A
60
112
68
88
64
110
60

A-A
118
68
88
116
64
60
94
92

82
76
74
72
92,94
56,58

SUPERSTRUCTURE POINTS DEVICE

The invention relates to a superstructure points device, in particular intended for a grooved rail, comprising a box-like substructure with stock rail, if necessary an additional/supporting rail and slide plate on which a tongue rail is slidably mounted.

A corresponding points device is shown for example in DE 42 01 757 A1, in which the box-like substructure, which comprises a truss plate, is welded onto the stock rail and additional rail, incorporated into a road bed and surrounded with bitumen, for example. Each box-like substructure is rigidly mounted, with the two box-like substructures associated with one points device being settable in respect of their distance from one another by a tie rod, for example.

The problem underlying the present invention is to mount the rails of the points device elastically, while also allowing the option of simple removal from the rail/road bed.

The problem is solved in accordance with the invention substantially in that the box-like substructure comprising at least the stock rail and the slide plate is mounted elastically in a stationarily arranged frame which in turn can be rigidly mounted. In this case, the two frames associated with one points device are also kept a defined distance apart using track rods, for example. In particular, the substructure is supported in suspended form in respect of the frame.

With the teachings in accordance with the invention, the possibility is achieved of elastically mounting the stock rail and slide plate and also in particular the additional/supporting rail in the case of grooved rail points, without the risk of an inadmissible track change; because the box-like substructure is accommodated by a frame that is substantially stiffly mounted, to that extent creating conditions such as those which have to be taken into account in conventional points devices, in particular in grooved rail points.

In an embodiment of the invention, it is provided that the box-like substructure has side walls running parallel or approximately parallel to one another and in the longitudinal direction of the points device and being connected by an elastic intermediate layer to the frame or to a holding element extending therefrom. The result of this is an elastically supported relative movement between the box-like substructure and the frame, and hence the required elastic mounting of stock rail and slide plate, on which in turn a tongue rail is slidably mounted.

The elastic intermediate layer can also be a spring element or spring assembly.

The elastic intermediate layer, which can consist of an elastomer for example whose characteristic can be designed such that the spring stiffness in the vertical direction differs from that in the horizontal direction, should be connected, for example by vulcanization, to a block-like flat element such as a flat bar element on the substructure side and to a preferably L-shaped element on the frame side. The flat element and the L-shaped element can extend on the one side from the box-like substructure and on the other side from the frame or from the holding elements connected thereto. Alternatively, the flat element, L-shaped element and the elastic intermediate layer can be designed as a unit and as such be arranged, practically as an insert, between the frame and the substructure in a positive connection.

The transverse web of the L-shaped element connected to the elastic intermediate layer runs at a distance from both the intermediate layer and the flat element such as flat bar element, and engages in a recess such as a groove in the side wall of the box-like substructure, with the height of the groove being greater than the corresponding extent of the transverse web of the L-shaped element. The groove therefore exerts the function of limitation for any relative movement between the box-like substructure and the frame in the vertical direction.

The transverse web of the L-shaped element itself extends in particular from a bracket-like projection of the frame or is supported on it. In a particularly noteworthy embodiment of the invention, the L-shaped element itself extends from a T-shaped element engaging in the bracket-like projection or is gripped by the latter. The central web of the T-shaped element has on the bottom side hook-like sections that engage in appropriate recesses of the bracket-like projection. This results in the possibility of removing the box-like substructure as well as the T-shaped elements connected by the elastic intermediate layers as a single unit from the frame, or to insert them into the frame such that interchangeability and maintenance is possible with little design and assembly work.

It is furthermore provided that the hook-like sections engage in the corresponding recesses of the bracket-like projection with play sufficient to allow a relative movement in the transverse direction of the points device, with the result that a required track adjustment is possible with fixed-location frames. To do so, it is additionally provided that spacer elements such as shim plates are arrangeable between longitudinal webs of the T-shaped element and longitudinal inner side walls of the frame for the purpose of aligning the box-like substructure relative to the frame.

The block-like flat element such as flat bar element that is connected to or in contact with the box-like substructure, i.e. the outer surface of the side wall, is preferably covered at the top by a lateral and outward-projecting section such as a nose on the side wall of the box-like substructure, or the projection rests on the flat element for support of the box-like substructure. Here the projecting section such as the nose is aligned in particular flush with the transverse web of the T-shaped element, however at a distance from it, with a section of the elastic intermediate layer extending between the transverse web and the projecting section.

With the transverse web section at a distance from the substructure, the T-shaped element itself rests on the appropriate side wall of the frame, which in turn has a U-shaped geometry.

The flat element, intermediate layer and L-shaped element can also be replaced by an elastic insert fixed between the bracket-like projection and the transverse web of the L-shaped element or a corresponding projection of the frame and the outward-facing projection such as the nose.

In order to follow the required curvatures of the points device without having to depart from the design in accordance with the invention, it is furthermore provided in a noteworthy embodiment that in the longitudinal direction of the points device the L-shaped element and the block-like flat element comprise sections at a distance from one another, between which the elastic intermediate layer passes over the entire length. Here the elastic intermediate layer between the sections of the L-shaped element and the flat element at a distance from one another has a transverse extent which is in particular equal to the sum of the transverse extents of the longitudinal web of the L-shaped element, the block-like flat element and the intermediate layer section passing between them.

Further details, advantages and features of the invention are shown not only in the claims and in the features they contain—singly and/or in combination—but also in the following description of a preferred embodiment shown in the drawing.

The drawing shows in

Figure 2:
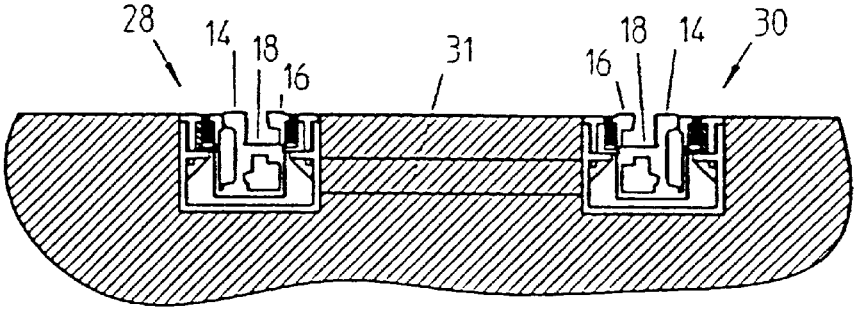
Figure 3:
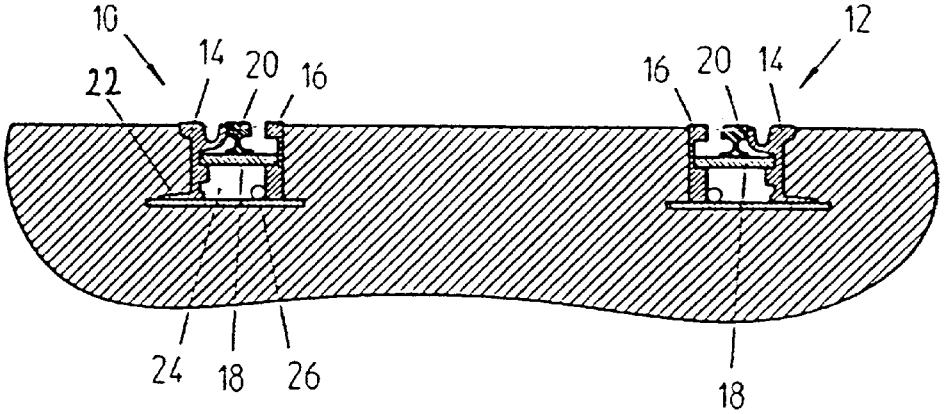
Figure 4:
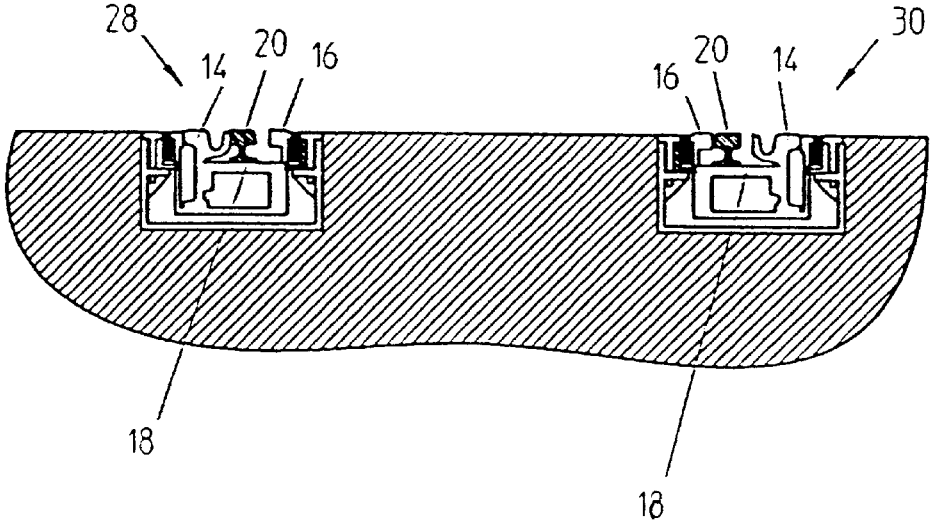
Figure 5:
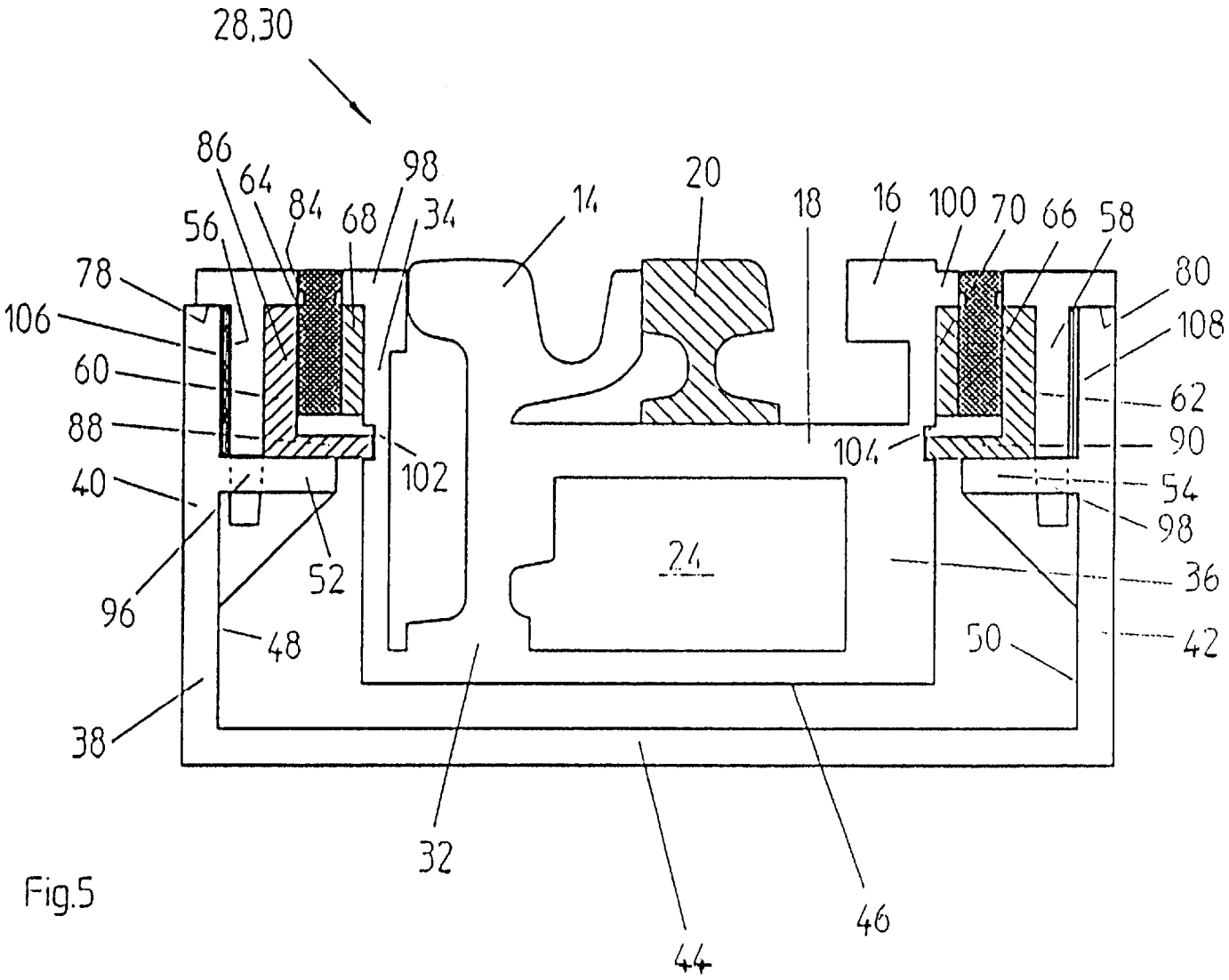
Figures 6, 7, 8, 9:
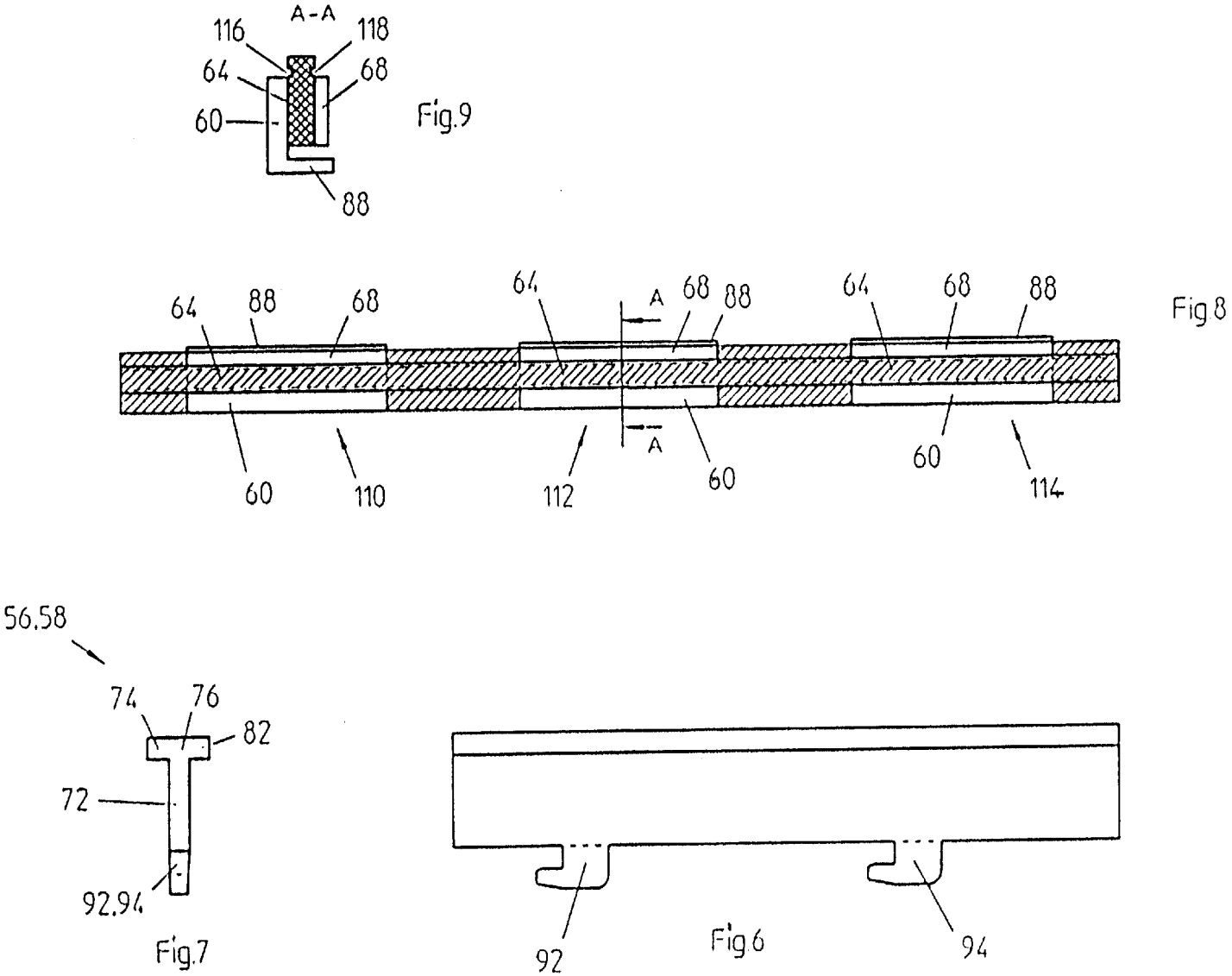

FIG. 1 a cross-section in the area of the start of grooved rail points with points devices of the prior art, FIG. 2 a cross-section corresponding to FIG. 1 with points devices designed in accordance with the invention, FIG. 3 a cross-section through grooved rail points in the central area with points devices the prior art, FIG. 4 a cross-section corresponding to FIG. 3 with points devices designed in accordance with the invention, FIG. 5 a cross-section through a points device in accordance with the invention, FIG. 6 a side view of an element, FIG. 7 the element in accordance with FIG. 6 in a front view, FIG. 8 a plan view of a connection of the points device in accordance with the invention, and FIG. 9 a section along the line A—A in FIG. 8.

The teachings in accordance with the invention are explained using grooved rail points, without thereby restricting the teachings in accordance with the invention. In the sectional illustrations in FIGS. 1 and 3, points devices of the prior art are shown, and in the other Figs. points devices in accordance with the invention or elements thereof, with the same reference numbers largely being used for identical elements.

FIG. 1 shows a cross-section at the start of grooved rail points and FIG. 3 a cross-section in the central area of grooved rail points. The points comprise in the known form two points devices 10, 12, comprising a stock rail 14, an additional rail 16 and a slide plate 18. A points device 20 is slidably mounted on the slide plate 18. The stock rail 14 and the supporting/additional rail 16 extend from a common plate 22 and are preferably welded to one another. The same applies between slide plate 18 and stock rail 14 and additional rail 16. A heating pipe 26 can run inside the chamber-like area 24 formed between the sole plate 22, the slide plate 18, the stock rail 14 and the additional/supporting rail 16. To that extent, reference is made here to well known designs. The points device 10, 12 thus formed and making up one unit is for example arranged on wooden sleepers, embedded in paving or surrounded with bitumen, as indicated by the hatching around the points devices 10, 12. In addition, the points devices 10, 12 are connected to one another by a tie rod. The known points devices designed to the prior art are themselves rigidly mounted.

FIGS. 2 and 4 show the cross-sections corresponding to those in FIGS. 1 and 3 of grooved rail points having the points devices 28, 30 in accordance with the invention, which can also be connected to one another by a tie rod 31. The points devices 28, 30 are also—as in the prior art—designed approximately identical.

Unlike in the prior art, the rails, i.e. the stock rail 14, the supporting/additional rail 16 and the tongue rail 20, are elastically mounted. Regardless of this, the points device 28, 30 per se is also mounted rigidly in a predetermined bed. To that end, the design is as follows.

In FIG. 5 the points device 28 is shown enlarged, with the points device 30 opposite, connected by the tie rod 31, for example, having a corresponding design. The points device 28 comprises a box-like substructure 32 comprising the stock rail 14, the supporting/additional rail 16 and the slide plate 18. In addition, a side wall 34 extends on the outside along the stock rail 14. The opposite side wall 36 merges on the top side into the additional/supporting rail 16. The box-like substructure 32 thus formed, which can also have a chamber 24 corresponding to that in FIGS. 1 and 3 with a heating means, not shown, is elastically mounted relative to a frame 38 of U-shaped section. The frame 38 comprises side walls 40, 42 running parallel or approximately parallel to the side walls 34, 36 of the box-like substructure 32, and a bottom 44 extending parallel or approximately parallel to the bottom surface 46 of the box-like substructure 32.

Bracket-like, i.e. preferably horizontally running projections 52, 54 project from the side walls 40, 42, i.e. from their inner surfaces 48, 50, on which projections rest an element 56, 58 of T-shaped section and also an L-shaped holding element 60, 62 respectively. The L-shaped holding elements 60, 62 are connected in particular by vulcanization to an elastic intermediate layer 64, 66 of rectangular section that is connected on the opposite side to a block-like flat element such as a flat bar 68, 70, preferably also by vulcanization, which in turn is in contact with associated side walls 34, 36 of the box-like substructure 32 and is if necessary connected thereto.

The longitudinal web 72 of the T-shaped element 56, 58 runs parallel or substantially parallel to the side wall 40, 42 of the frame 38 and hence to the side wall 34, 36 of the box-like substructure 32. The element 56, 58 rests with a section 74 of its transverse web 76 on the upper edge 78, 80 of the side wall 40, 42.

On the substructure side, the L-shaped element 60, 62, whose width corresponds to the transverse extent of the free section 82, extending on the substructure side, of the transverse web 76 of the T-shaped element 56, 58, extends along the longitudinal web 72 of the T-shaped element 56, 58, i.e. the front surface 84 of the transverse web 76 and the substructure-side surface 86 of the L-shaped element merge flush into one another. The L-shaped element 60, 62 furthermore rests with its transverse web 88, 90 on the bracket-like projection 52, 54.

As a result, the longitudinal web of the L-shaped element 60, 62 is positively arranged between the T-shaped element 56, 58 and the bracket-like projection 52, 56. If necessary a non-positive connection can also be made.

It can furthermore be seen that the longitudinal web 72 of the T-shaped element 56, 58 has hook-like projections 92, 94 on the bottom side, which engage in corresponding recesses 96, 98 that are provided in the bracket-like sections or projections 52, 54 of the frame 38 and that extend in the longitudinal direction of the points device 28, 30.

The flat bar element 68, 70 is covered at the top side by an outward-projecting edge-side projection 98, 100 of the side wall 34, 36 that merges flush on the end surface/outer side with the corresponding outer surface of the flat bar 68, 70 facing the intermediate layer 64, 66. If a non-positive connection between the flat bar 68, 70 and the side wall 34, 36 is not made, the side wall 34, 36 and hence the box-like substructure 32 rests on the flat bar 68, 70 with its projections 98, 100.

Between the corresponding surfaces, merging flush with one another, of the flat bar 68, 70 and of the projection 98, 100, also referred to as nose, of the side wall 34, 36 on the one hand, and the surface 84, 86 of the T-shaped element 56, 58 and of the L-shaped element 60, 62 on the other hand, runs the elastic intermediate layer 64, 66, which is connected to the surfaces in particular by vulcanization. This results in the required elastic connection between the box-like substructure 32 and the frame 38, the substructure 32 being held suspended in respect of the frame 38.

In order to limit the vertical movement between the box-like substructure 32 and the frame 38, the following design measure has been taken: the side wall 34, 36 of the box-like substructure 32 has in its respective outer surface a groove 102, 104 in which engages in the front end of the respective transverse web 88, 90 of the L-shaped element 60, 62. In addition, the transverse web 88, 90 runs at a distance from both the elastic intermediate layer 64, 66 and from the flat bar 68, 70. The height extent of the transverse web 88, 90 is furthermore less than the width of the groove 102, 104. As a result the side walls of the groove 102, 104 effect a limitation in the vertical direction of the relative movement between the box-like substructure 32 and the frame 38.

The T-shaped element 56, 58 passes with its hook-like section 92, 94 on its bottom through the corresponding opening or recess 96, 98 in the bracket-like projection 52, 54 such that adjustment of the box-like substructure 32 relative to the frame 38 is possible, in order to insert distance elements such as shim plates 106, 108 to the required extent between the longitudinal web 56, 58 and the inner surface of the side wall 40, 42 of the frame 38 , thereby permitting a horizontal adjustment of the box-like substructure 32 relative to the frame 38.

So that points devices 28, 30 can follow the course of the points, which can correspond to a polygon, it is provided that the intermediate layer 64, 66 connected to the flat bar 68, 70 and the L-shaped element 60, 62 comprises sections at a distance from one another and flush with one another transverse to the points longitudinal direction, said sections being numbered 110, 112 and 114 in FIG. 8, with the other reference numbers remaining unchanged.

In the cavity between the sections 110, 112, 114, the elastic intermediate layer 64, 66 has a large cross-section such that its outer surfaces are flush with the outer surfaces of the flat bar 68 and of the longitudinal web of the L-shaped element 60, as the plan view in FIG. 8 shows.

Furthermore, the elastic intermediate layer 64 has above the flat bar 68 or the longitudinal web of the L-shaped element 60 extending from the respective outer surface a groove-like recess 116, 118 for permitting a relative movement between that section of the intermediate layer 64, 66 which is between the transverse web 76 of the T-shaped element 56, 58 and the projection (nose) 98, 100 of the side wall 34, 36 of the box-like substructure 32, and the remaining section.

An elastic connection between the box-like substructure 32 and the frame 38 can be achieved by one or more elastic elements, which can be springs or spring assemblies, running between facing receptacles in frame 38 and substructure 32, i.e. practically replacing flat bar element 68, 70, intermediate layer 64, 66 and L-shaped element 60, 62.

It is also possible to achieve the elastically suspended connection in that the unit assuring elasticity, or insert, is limited at the top by facing projections of the frame 38 and the substructure 32 and at the bottom by, for example, the bracket-like projection 52, 54.

What is claimed is:

1. A superstructure points device for grooved rail points, comprising:

a box-like substructure (32) with at least a stock rail (14), and a slide plate (18) on which a tongue rail (20) is slidably mounted, wherein the box-like substructure (32) is mounted elastically in a frame (38) of the points device (28, 30), said frame is stationarily arranged on a sleeper or embedded in a paving, wherein the box-like substructure (32) has side walls (34, 36) running parallel to one another and in the longitudinal direction of the points device (28, 30) and being connected by an elastic intermediate layer (64, 66) to a holding element (56, 58) extending therefrom, wherein the elastic intermediate layer (64, 66) is connected, to a block-like flat element (68, 70) on the substructure side and to an L-shaped element (60, 62) on the frame side, and wherein a transverse web (88, 90) of the L-shaped element (60, 62) runs at a distance from both the elastic intermediate layer (64, 66) and the flat element (68, 70) and engages in a recess (102, 104) in the side wall (34, 36) of the box-like substructure (32), with the height of the recess being greater than the corresponding extent of the transverse web.

2. Superstructure points device according to claim 1, wherein the box-like substructure (32) is supported in suspended form in respect of the frame (38).

3. Superstructure points device according to claim 1, wherein the box-like substructure (32) is supported by an elastic insert relative to the frame (38).

4. Superstructure points device according to claim 1, wherein the flat element (68, 70), the L-shaped element (60, 62) and the elastic intermediate layer (64, 66) can be fitted as an insert between the box-like substructure (32) and the frame (38) for mutual elastic support and are connected therewith.

5. Superstructure points device according to claim 1, wherein the recess (102, 104) is, when the transverse web (88, 90) of the L-shaped element (60, 62) connected to the intermediate layer (64, 66) engages in said recess, the limit for a vertical relative movement between the box-like substructure (32) and the frame (38).

6. Superstructure points device according to claim 1, wherein the transverse web (88, 90) of the L-shaped element (60, 62) is supported on a bracket-like projection (94, 96) of the frame (38).

7. Superstructure points device according to claim 6, wherein the L-shaped element (60, 62) extends from a T-shaped element (56, 58) engaging in the bracket-like projection (52, 54) and whose central web (72) has on the bottom hook-like sections (92, 94) engaging in corresponding sections (96) of the bracket-like projection.

8. Superstructure points device according to claim 7, wherein the L-shaped element (60, 62) is positively mounted on the frame side between the T-shaped element (56, 58) and the bracket-like projection.

9. Superstructure points device according to claim 7, wherein the T-shaped element (56, 58) is detachably connected to the frame (38) by the hook-like sections (92, 94).

10. Superstructure points device according to claim 7, wherein the hook-like sections (92, 94) of the T-shaped element (56, 58) engage in the recesses (96, 98) of the bracket-like projections (52, 54) with play sufficient to allow a relative movement between the frame (38) and the box-like substructure at least transverse to the longitudinal direction of the points device (28, 30).

11. Superstructure points device according to claim 7, wherein the transverse web (76) of the T-shaped element (56,58) rests on the upper edge of the frame (38).

12. Superstructure points device according to claim 7, wherein the T-shaped element (56, 58) engages transversely to the points device longitudinal direction in the recess (56, 58) of the bracket-like projection (52, 54) with sufficient play for spacer elements (106, 108) to be arrangeable between its longitudinal web (72) and the longitudinal inner side walls of the frame (38).

13. Superstructure points device according to claim 7, wherein the box-like substructure (32) with the T-shaped element (56, 58) connected via the elastic intermediate layer (64, 66) can be removed from or inserted into the frame (38) as a unit.

14. Superstructure points device according to claim 7, wherein the transverse web (76, 82) of the T-shaped element (56, 58) rests on the upper edge of the longitudinal web of the L-shaped element (60).

15. Superstructure points device according to claim 1, wherein the frame (38) has a U-shaped cross-section.

16. Superstructure points device according to claim 1, wherein the box-like substructure (32) is removable from the frame (38) separately from the insert comprising the L-shaped element (60, 62), the intermediate layer (64, 66) and the flat element (68, 70).

17. Superstructure points device according to claim 7, wherein the T-shaped element (56, 58) and the L-shaped element (60, 62) are the holding element.

18. Superstructure points device according to claim 1, wherein the block-like flat element (68, 70) on the substructure side is covered at the top by a lateral outward-projecting section (98, 100) of the side wall (34, 36) of the box-like substructure (32).

19. Superstructure points device according to claim 18, wherein the section (98, 100) and the facing transverse web section (82) of the T-shaped element (56, 58) are aligned with one another.

20. Superstructure points device according to claim 19, wherein a section of the elastic intermediate layer (64, 66) extends between the projecting section (98, 100) of the side wall (34, 36) of the box-like substructure (32) and the facing transverse web (82) of the T-shaped element (56, 58).

21. Superstructure points device according to claim 1, wherein the L-shaped element, the intermediate layer (64) and the block-like flat element (68) are designed as a unit.

22. Superstructure pints device according to claim 1, wherein in the longitudinal direction of the points device (28, 30) the L-shaped element (60) and the flat element (68) comprise sections (110, 112, 114) at a distance from one another, between which the elastic intermediate layer passes over the entire length.

23. Superstructure points device according to claim 1, wherein the elastic intermediate layer (64, 66) between the sections (110, 112, 114) of the L-shaped element (60, 72) and the flat element (68, 70) has a transverse extent which is equal to that of L-shaped element in respect of its longitudinal web, the flat element and the intermediate layer section passing between them.

* * * * *